United States Patent [19]

Hamm et al.

[11] Patent Number: 4,982,660

[45] Date of Patent: Jan. 8, 1991

[54] CHAMBERED DOCTOR BLADE INKER SYSTEM

[75] Inventors: Anton Hamm, Neusäss; Thomas John, Augsburg, both of Fed. Rep. of Germany

[73] Assignee: Man Roland Druckmaschinen AG, Offenbach am Main, Fed. Rep. of Germany

[21] Appl. No.: 448,810

[22] Filed: Dec. 11, 1989

[30] Foreign Application Priority Data

Dec. 21, 1988 [DE] Fed. Rep. of Germany ..... 3843017

[51] Int. Cl.[5] ..... B41F 31/04

[52] U.S. Cl. ..... 101/350; 101/157

[58] Field of Search ..... 101/157, 349, 350

[56] References Cited

FOREIGN PATENT DOCUMENTS

2646071C2 4/1978 Fed. Rep. of Germany .

3241124A1 5/1984 Fed. Rep. of Germany .

3704433A1 8/1988 Fed. Rep. of Germany .

*Primary Examiner*—Edgar S. Burr

*Assistant Examiner*—John S. Hilten

*Attorney, Agent, or Firm*—Frishauf, Holtz, Goodman & Woodward

[57] ABSTRACT

The chambered doctor blade unit is intended to ink an anilox roller (10) with ink having a viscosity of at least 1 d Pa s and preferably greater than 40 d Pa s. Each of the side walls (3) when the inker is in operative position with respect to the anilox roller (10) form circumferential gaps (13) with respect to the anilox roller, having a width (A) of between about 0.1 to 3 mm, thereby preventing wear and tear on the side walls and sealing of the receptors or cells of the anilox roller with a braided material. The doctor blades (4, 5) are resiliently pressed against upper (20) and lower edges of the side walls, to prevent formation of undulation, the side walls being formed with recessed surfaces (11) facing the anilox roller, with abraded surfaces terminate in inclined relief surfaces (19) forming an inclined gap, to permit escape of ink adjacent the lateral surfaces. To prevent uncontrolled escape of ink, an ink deflection shield (22) extends from the outside of the side walls towards an ink trough (9) and forming a run-out chamber with the relieved surfaces.

12 Claims, 2 Drawing Sheets

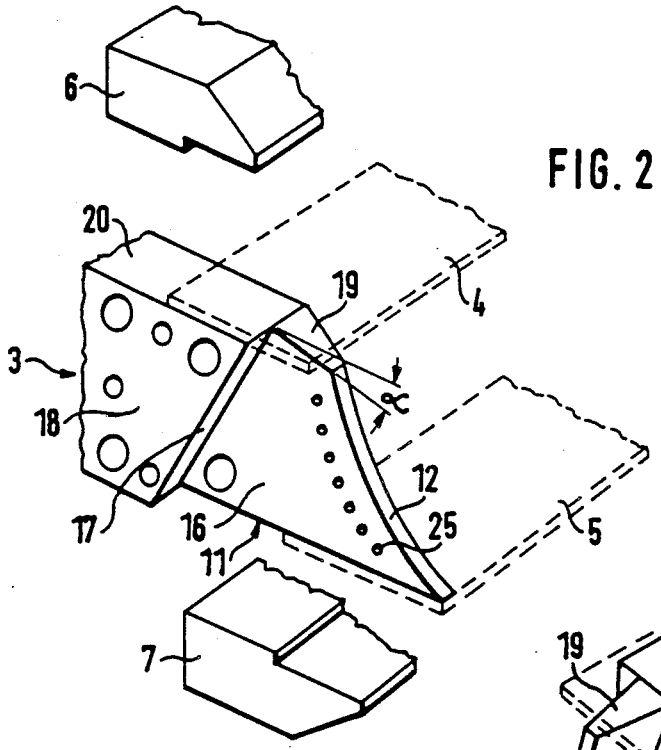
FIG. 2
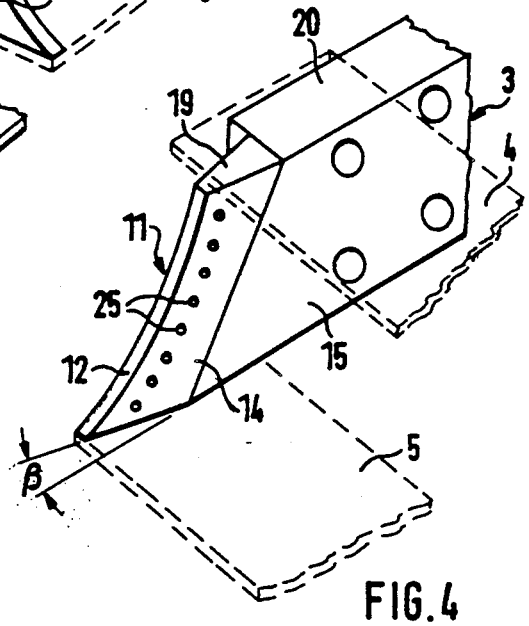
FIG. 4
FIG. 3
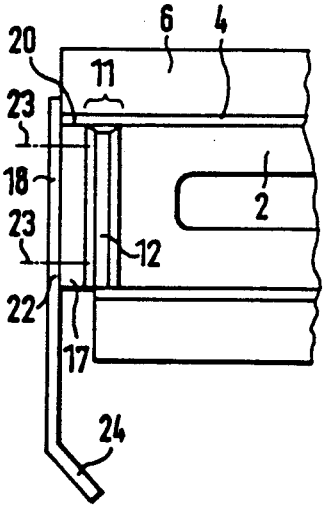

CHAMBERED DOCTOR BLADE INKER SYSTEM

Reference to related applications, the disclosures of which are hereby incorporated by reference, and all assigned to the assignee of the present invention:

U.S. Ser. No. 07/403,754, filed Sept. 6, 1989, JOHN

U.S. Ser. No. 07/403,760, filed Sept. 6, 1989, BOCK et al

U.S. Ser. No. 07/403,620, filed Sept. 6, 1989, BOCK et al

Reference to Related Publications

DE OS 37 04 433 A1, Norbert KOBLER et al

DE OS 32 41 124 A1, Georg SCHNEIDER.

DE PS 26 46 071 C2, Eckhard BRANDT.

The present invention relates to printing machines, and more particularly to inker systems for printing machines, and especially to inker systems which apply printing ink to an ink roller which has a textured surface, such as an anilox roller, which has tiny depressions or cells. Inkers suitable for use with anilox rollers can be constructed in the form of chambered doctor blade inking systems, and the present invention relates to such inking systems which are so arranged that the cells or receptors of the inking roller will not be clogged by material rubbed off from the inker system.

Background

The referenced applications U.S. Ser. No. 07/403,754, filed Sept. 6, 1989, John; U.S. Ser. No. 07/403,760, filed Sept. 6, 1989, Bock et al now U.S. Pat. No. 4,938,133 issued July 3, 1990; U.S. Ser. No. 07/403,620, filed Sept 6, 1989, Bock et al, described chambered doctor blade unit or units. The chambered doctor blade system may include housing structure of, in cross section, generally U shape, and two side walls. At least one doctor blade, which can flex in the direction towards the side walls, is engageable toward an anilox roller.

German Patent disclosure documents DE OS 37 04 433 illustrates a chambered doctor blade unit which has sealing bars laterally defining the unit. The sealing bars are elastically biased against the anilox roller and, additionally, can be engaged against the side edges of the doctor blade.

It has been found that such a system has a disadvantage namely that, in the course of operation, wear tracks will form. Ink striping may occur along these wear strips or tracks on the anilox roller which, in continuous operation, may become thicker and thicker, so that ink can splash off therefrom. Uneven ink supply may occur upon even slightly excess supply of ink to the unit.

The arrangement by which a doctor blade unit is clamped laterally between the sealing bars requires very precise maintenance of the length of the doctor blade which increases the cost, due to the low tolerances which will be needed.

Laterally fitting the edges of the doctor blade against the sealing bars with even slight pressure results in andulating deformation of the doctor blade. Typically, doctor blades are flexible, and have a thickness of between 0.2 to 0.3 mm. Upon lateral pressure against such a thin elongated element, it will form wavy lines so that, upon engagement of such a wavy line with a circumference of the anilox roller, the anilox roller is not uniformly stripped of ink but, rather, ink stripes may form thereon. The arrangement, however, requires a tight fit, laterally against a doctor blade, as well as circumferentially against the anilox roller, to prevent ink from escaping.

German patent disclosure document DE OS 32 41 124 is a structure which does not use a doctor blade and, only generally, shows an ink system. German patent No. 26 46 071 likewise is an inker which does not use a doctor blade, but, rather, has cooperating inker rollers or cylinders, which are supplied with splashing plates to prevent splashing of ink off the circumferences of the roller.

The Invention

It is an object to improve a chambered doctor blade unit of this type in such a manner that the lateral boundaries of the unit, typically the side walls, are so constructed that no particles rubbed off therefrom can impact in the receptors or cells of the anilox roller, and which is simple to construct.

Briefly, the system is designed for inks having a viscosity of at least 1 d Pa s (deci Pascal second), preferably greater than 40 d Pa s. Each of the side walls, when the inker is in operative position with respect to an anilox roller, form circumferential gaps with respect to the anilox roller of between about 0.1 to 3 mm. The at least one doctor blade is resiliently pressed against an upper edge of the side walls, and the side walls are formed with inclined relief surfaces which define wedge-shaped gaps between the side walls and the doctor blade, at a location beneath the end of the doctor blade which faces the anilox roller Excess ink deflection shields extend from outside of the side walls towards the ink trough, positioned adjacent the edge faces of the doctor blade, to direct ink dripping off, for example from these gaps, into an ink trough of the inker system.

The inker system of the present invention is particularly suitable for use in offset printing machines.

DRAWINGS

FIG. 2 is an exploded view of a side wall of the inker;

FIG. 3 is a fragmentary front view of the inker shown in FIG. 1;

FIG. 4 is a prospective view of the side wall of the inker opposite the one shown in FIG. 2;

DETAILED DESCRIPTION

Figure 1:
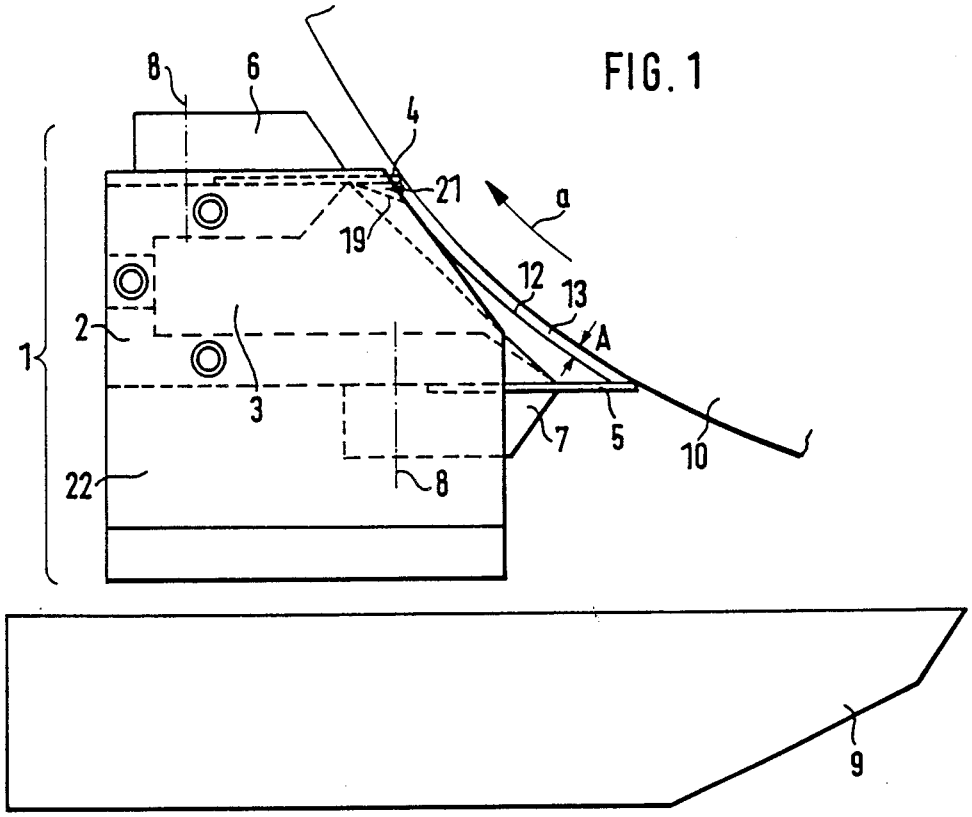
FIG. 1 is a schematic side view of an inker in accordance with the present invention, engaged against an analog roller, shown only in fragmentary form, and in which all elements and structural connections, not necessary for an understanding of the present invention, have been omitted.

The inker of the present invention is illustrated in an example intended for use with an offset printing machine, although it is not limited thereto A chambered doctor blade unit 1 (FIG. 1) uses a U-shaped base body 2, two sidewalls 3, and two doctor blades 4, 5. The doctor blades 4, 5, are clamped by clamping strips or rails 6, 7 against upper and lower surfaces of the side walls 3. Screws 8, shown only schematically, provide for the clamping force. An ink trough 9 is located beneath the inker, as well known. Structural elements and components to secure the inker as well as the ink trough to the frame of a printing machine have been omitted since such structural elements can be of any desired form.

The referenced applications:

U.S. Ser. No. 07/403,754 filed Sept. 6, 1989, JOHN
U.S. Ser. No. 07/403,760, filed Sept. 6, 1989, BOCK et al now U.S. Pat. No. 4,938,133 issued July 3, 1990
U.S. Ser. No. 07/403,620, filed Sept. 6, 1989, BOCK et al
also illustrate arrangements to attach such a chambered doctor blade unit to a printing machine.

The chambered doctor blade unit can be engaged against an anilox roller 10, with the two doctor blades 4, 5 in engagement therewith. The doctor blade 4 removes excess ink when the anilox roller rotates in the direction of the arrow a; the doctor blade 5 closes off the chambered unit towards the bottom.

As best seen in FIGS. 2 and 4, the respective side walls 3 have a region 11 of reduced width which faces the anilox roller 10. Preferably, the reduction of width is essentially continuous, becoming narrower towards the doctor blade 10 and terminating in the front by a curved narrow surface 12. The surface 12 forms a gap 13 (FIG. 1) with the anilox roller 10. The size A of the ga is between about 0.1 and 3 mm. It is not necessary that the width of this gap is uniform throughout the entire length of the surface 12; rather, the width of the gap may vary within the dimensions given.

The inner side 14 of the region 11 merges with the inner side 15 of the side wall 3. The inner side 14 of the region 11, however, is inclined by an acute angle $\beta$, as best seen in FIG. 4. The other side 16 of the region 11 engages with an approximately right angle against an inclined end wall 17 of the sidewall 13, so that the outside 16 is inwardly recessed with respect to the outer wall of the wall 3.

In accordance with the feature of the invention the region 1 is formed with an inclined surface 19 at the upper side 20 thereof which forms an acute angle $\alpha$ with the upper side 20 of the side wall 3. The inclination 19, which will occur between the doctor blade and the top surface of the region 11 will form a wedge-shape gap 21 (FIG. 1). The height of this wedge-shaped gap, closest to the outer end of the doctor blade 4 is at least 0.1 mm. The inclination permits, and insures, that the doctor blade 4, upon engagement against the anilox roller 10, can resiliently slightly deflect. This, in combination with the clamping by the jaw 6, 7 o the doctor blades against the upper and lower surfaces, respectively, of the sidewalls effectively prevents forming of undulations.

As best seen in FIG. 3, the doctor blade 4 is clamped by the clamping strip 6 against the base body 2 as well as against the upper side surface 20 of each one of the side walls 3. The doctor blade 4 terminates in the plane of the outer wall 18 of the side wall 3, thus extends with the end facing the anilox roller 10 beyond the regions or zones 11 towards the outside thereof.

The doctor blade 5 is clamped by the clamping strip or rail 7 against the base body 2 and against the lower surfaces of the side wall 3 including the region 11. It thus closes off the chambered doctor blade unit 1 up to the surface 12 and seals the unit.

The arrangement can be used not only for inkers in which the anilox roller operates in the direction of the arrow a , but also for printing machines in which the direction of rotation of the anilox roller is reversible In systems in which the direction is reversible, it is best to so arrange both doctor blades that they are inclined towards each other at the end facing the anilox roller and to use that one of the doctor blades which is negatively engaged against the anilox roller 2 to strip off excess ink.

An excess ink deflection shield 22 is located against the surface 18 of the side wall 3 and is also adjacent the lateral outer side of the doctor blade 4. The ink defection shield extends at one end at least up to the edge surfaces of the doctor blade and at the other end until just above the ink trough 9. The shield 22 is connected to the associated side wall 3 by screws 23 (FIG. 3). Preferably, the lower end 24 of the shield 22 is angled off inwardly so that any ink which drips off along the shield is reliably directed into the trough 9. Ink run-off chambers are formed betwen shields 22 and the thinner regions 11 of the side walls 3.

Bypass bores 25 (FIGS. 2, 4) may be located in the region 11 of the side walls. This prevents undesired excess hydrodynamic pressure against the doctor blade 4 when the inker is in operation Such pressure may cause deformation of the doctor blade which is positively engaged against the doctor blade 10, which deformation may then lead to non-uniforming engagement against the anilox roller 10.

Operation

When the machine is stopped, and ink is supplied to the inker system, the dynamic viscosity of which is greater than 1 d Pa s, and preferably greater than 40 d Pa s, and the inker is engaged against the anilox roller 10, ink will first ooze out of the gap 13 as well as from the wedge shaped gap 21. Ink may escape through the space between the shield 22 and the outside 16 of the region 11 of the side wall 3, to be returned to the ink trough 9 It has been found that, when the anilox roller 10 is stopped, hardly any wetting of the anilox roller 10 with ink will occur in the region of the overlap of the doctor blade 4 beyond the region 11 of the side wall 3.

Figure 5:
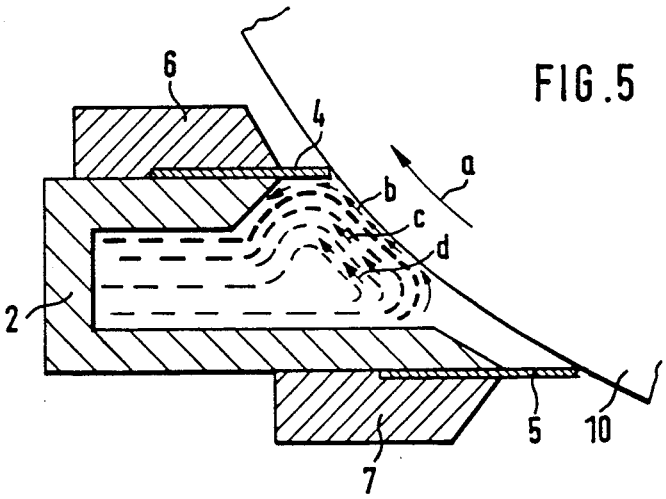
FIG. 5 is a schematic representation of ink flow arising in the inker of the present invention, when in operation.

Upon starting the machine, and rotating the roller 10 in the direction of the arrow a , the surface of the anilox roller 10 will accept ink, which will be carried along circumferentially by the roller 10. Referring to FIG. 5: ink which is not received in the receptors or cells of the anilox roller 10 is carried along in the direction of the arrows b, c, d The speed of the ink as it is carried along, immediately adjacent the anilox roller 10 will be highest as indicated by the number of arrows. Towards the inside of the chambered doctor blade unit, the circulating speed of the ink within the unit drops off, compare arrows b, c and d. At the same time, ink flow parallel to the axis of the doctor blade 10 is reduced. At already intermediate speeds, this has the result that no ink will escape through the gap 13 Slight escape of ink will occur, however, only through the gap 21 beneath the doctor blade 4, formed by the inclination 19. Any ink escaping from the gap 21 will be deflected by the shield 22 to drip back into the in trough 9. Ink escaping through the gaps 21, one at either side of the inker, insures that the anilox roller 10 is sufficiently inked so that the outer side 16 of the regions 11 of the side wall can coincide with the edges of subject matter to be printed. The ink escaping through the gaps 21 still provides ink to the anilox roller also in the lateral regions that complete tonal depth for printing is obtained even in the side regions within measurable tolerances; beyond this limit, however, the anilox roller will not be inked.

The unit 1 is not in physical engagement with the anilox roller, rather is applied towards the anilox roller contact-less. Consequently, no wear and tear of the curved surfaces 12 will arise, and no filling of cells or receptors in the anilox roller will result. Resilient adjustment elements are not necessary, in order to compensate for any wear and tear upon physical engagement.

Various changes and modifications may be made within the scope of the inventive concept.

We claim:

1. For combination with a printing machine having an anilox roller (10) and an ink trough (9);

a chambered doctor blade inker system, wherein the chambered doctor blade inker system includes a base body (2) which, in cross section, is essentially U-shaped and extends axially essentially parallel to the anilox roller, and a pair of lateral side walls (3) having upper and lower surfaces (20) axially closing off said base body and defining therewith an ink chamber;

at least one axially extending flexible doctor blade (4), having edge faces, each of the side walls (3), when said system is in operating position with respect to the anilox roller (10), forming a circumferential gap (A) with respect to the anilox roller of between about 0.1 to 3 mm width;

means resiliently pressing the at least one doctor blade (4) against at least one of the upper and lower surfaces of said side walls (3);

the upper or lower surfaces of the at least one of said side wall (3) which contacts said doctor blade being formed with an inclined relief (19) to define a wedge-shaped gap (21) between the respective side wall and the at least one doctor blade (4), at a location between the upper or lower surface of the side wall which faces the at least one doctor blade (4);

an excess ink deflection shield (22) provided, extending towards said ink trough (9), said excess ink deflection shield being positioned adjacent an edge face of the doctor blade (4) and in fluid communication with said wedge-shaped gap (21).

2. The inker system of claim 1, wherein at least one doctor blade (4) is resiliently engaged against the upper surfaces (20) of said side walls.

3. The inker system of claim 1, wherein each one of the side walls (3) is formed with a region (11) of reduced wall thickness, said region being positioned in a zone facing the anilox roller (10), said region including said inclined relief (19);

and wherein said excess deflection shield (22) covers said recessed region to form with said recessed region an ink run-off chamber.

4. The inker system of claim 1, wherein the maximum height of said wedge-shaped gap (21) is at least 0.1 mm.

5. The inker system of claim 3, wherein the maximum height of said wedge-shaped gap (21) is at least 0.1 mm.

6. The inker system of claim 3, wherein the regions (11) of reduced wall thickness of said side walls are recessed regions (11), located in a zone adjacent the anilox roller (10);

and wherein said recessed regions taper towards a narrower width adjacent said circumferential gaps (A).

7. The inker system of claim 1, wherein said side walls are formed with recessed regions (11), said recessed regions being located in zones adjacent said anilox roller;

and wherein said recessed regions (11) are formed with bypass through-bores (25) communicating with the interior of the ink chamber.

8. The inker system of claim 3, wherein said recessed regions taper in the direction of said gap (A).

9. The inker system of claim 3, further including through-bores (25) formed in said recess regions of the side walls and communicating with said run-out ink chamber.

10. The inker system of claim 9, wherein the maximum height of said wedge-shaped gap (21) is at least 0.1 mm.

11. The inker system of claim 1 in combination with ink within said ink chamber, said ink having dynamic viscosity of at least 1 d Pa s.

12. The inker system of claim 1 in combination with ink within said ink chamber, said ink having a dynamic viscosity of at least 40 d Pa s.

* * * * *